United States Patent [19]

Barnett et al.

[11] Patent Number: 5,043,246

[45] Date of Patent: Aug. 27, 1991

[54] SILVER COMPLEX DIFFUSION TRANSFER PROCESS EMPLOYING AN IMAGE-RECEIVING ELEMENT CONTAINING AN S-THIURONIUM ALKYL SULFONATE

[75] Inventors: Anthony M. Barnett, Bushey; Colin J. Gray, Harrow; Julie Baker, Rickmansworth, all of United Kingdom

[73] Assignee: Eastman Kodak Company, Rochester, N.Y.

[21] Appl. No.: 492,029

[22] Filed: Mar. 12, 1990

[30] Foreign Application Priority Data

May 18, 1989 [GB] United Kingdom ..... 8911431

[51] Int. Cl.[5] ..... G03C 5/54

[52] U.S. Cl. ..... 430/248; 430/233; 430/251; 430/455; 430/965

[58] Field of Search ..... 430/233, 248, 251, 455, 430/428, 429, 965, 234

[56] References Cited

U.S. PATENT DOCUMENTS

| | | | |
|---|---|---|---|
| 3,220,839 | 11/1965 | Herz et al. | 430/428 |
| 3,749,912 | 7/1973 | De Haes et al. | 430/248 |
| 3,932,480 | 1/1976 | Grasshoff et al. | 430/251 |
| 4,242,436 | 12/1980 | Mertens et al. | 430/248 |
| 4,322,493 | 3/1982 | Shibaoka et al. | 430/454 |

*Primary Examiner*—Richard L. Schilling

*Attorney, Agent, or Firm*—Alfred P. Lorenzo

[57] ABSTRACT

A non-light-sensitive image-receiving element useful in a silver complex diffusion transfer process includes at least one layer containing certain S-thiuronium alkyl sulfonates which act as tone controlling agents that accelerate the physical development of silver.

2 Claims, No Drawings

SILVER COMPLEX DIFFUSION TRANSFER PROCESS EMPLOYING AN IMAGE-RECEIVING ELEMENT CONTAINING AN S-THIURONIUM ALKYL SULFONATE

FIELD OF THE INVENTION

This invention relates in general to photography and in particular to image-receiving elements used in silver complex diffusion transfer processes. More specifically, this invention relates to non-light-sensitive image-receiving elements and to the use therein of certain tone controlling agents.

BACKGROUND OF THE INVENTION

The principle of the silver complex diffusion transfer process is described in British Pat. No. 614,155 filed Nov. 2, 1939. This process comprises the steps of exposing a photosensitive element containing a silver halide emulsion layer, developing the exposed photosensitive silver halide emulsion layer and forming a soluble silver complex of unexposed silver halide by treating the said photosensitive silver halide emulsion layer with an alkaline processing fluid in the presence of a developing agent and a silver halide complexing agent, transferring said soluble silver complex by diffusion to the silver receptive layer of an image-receiving element in superposed relationship with said silver halide emulsion, forming at said silver receptive layer an image incorporating silver from said silver complex under the action of development nuclei, and separating said image-receiving element from said photosensitive element. Certain compounds are now conventionally used in such non-light-sensitive image-receiving layers; for example 2-phenyl-5-mercapto-oxadiazole and 5-methylbenzotriazole. These compounds are utilized to control the density and tone of the positive image.

Other toners, such as those described in British Patents 950668 and 1158479, can either accelerate the production of a positive image as compared to an image-receiving layer having no toner added thereto, or as compared to an image-receiving layer with known development retarding toner, for example 1-phenyl-2-tetrazoline-5-thione.

All these compounds, although efficacious in their way, have drawbacks and accordingly the need exists to improve the performance of non-light-sensitive image-receiving layers and in particular to improve the speed of development which would allow a faster "strip time" and improve resolution and exposure latitude by decreasing sideways diffusion of complexed silver.

From U.S. Pat. No. 4,500,632 it is known that S-thiuronium alkyl sulfonates stabilize silver images formed in a photographic light-sensitive material against long term deterioration.

SUMMARY OF THE INVENTION

In accordance with this invention, it has been discovered that certain S-thiuronium alkyl sulfonates have the unexpected effect of accelerating the physical development of silver in non-light-sensitive image-receiving layers in a silver complex diffusion transfer process.

According to one aspect of the present invention there is provided therefore a non-light-sensitive image-receiving element for use in a silver complex diffusion transfer process having in at least one layer thereof an S-thiuronium alkyl sulfonate of the general formula:

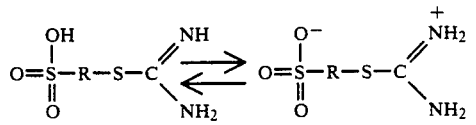

(1)

wherein R is a $C_1$–$C_6$ linear or branched, substituted or unsubstituted, alkylene group.

In a second aspect, the invention provides a silver complex diffusion transfer process, which process comprises passing a non-light-sensitive image-receiving element and an image-wise exposed light-sensitive silver halide element through a processing solution, laminating them in face to face contact, and stripping them apart when processing is over, said non-light-sensitive image-receiving element including an S-thiuronium alkyl sulfonate as above defined, thereby to accelerate the physical development of silver in the image-receiving layer.

DESCRIPTION OF THE PREFERRED EMBODIMENTS

In a preferred form of the invention R, as given above is selected from $$-CH_2CH_2CH_2- \quad (I)$$

$$-CH_2\overset{\overset{\displaystyle CH_3}{|}}{C}HCH_2- \quad (II)$$

$$-CH_2CH_2CH_2CH_2- \quad (III)$$

$$-CH_2CH_2\overset{\overset{\displaystyle CH_3}{|}}{C}H- \quad (IV)$$

or $$-CH_2CH_2- \quad (V)$$

The toners employed herein may be used in conjunction with toners of different types if desired. It has been shown that S-thiuronium alkylsulfonate toners in accordance with the foregoing accelerate the physical development of silver in the presence of development nuclei when incorporated in the non-light-sensitive image-receiving layers of a silver complex diffusion transfer process. Thus, when processed with a light-sensitive projection negative donor the faster developing receiver layers give improved resolution and exposure latitude without significant lowering of contrast. Furthermore, the maximum transmission densities obtained after 6, 12 or 30 seconds lamination are found to be increased over those achievable with the compounds of the prior art. Furthermore, when processed with a light-sensitive Kodak PMTII Continuous Tone Negative donor, the faster developing receiver layers are able to give improved (i.e. lower) contrast over that achievable with the compounds of the prior art.

The toners of this invention can be employed at concentrations from 1 to 500 mg/m$^2$, preferably from 20 to 150 mg/m$^2$.

The invention will now be described, by way of illustration only, in the following examples:

The toners were coated individually in the following format on polyethylene-coated paper base.

| PAPER BASE | |
|---|---|
| GELATIN, | 0.59 $g/m^2$ |
| GELATIN, | 0.54 $g/m^2$ |
| NUCLEI, | 1.92 mg $NiS/m^2$ |
| TONER, | 100 $mg/m^2$ |
| GELATIN, | 137 $g/m^2$ |

The nickel sulfide nuclei were formed by precipitation in a 5.2% (w/w) solution of gelatin from sodium sulfide (75 g/l) and nickel nitrate (35 g/l). The dispersion was then stabilized by the addition of silver iodide and other solutions before coating on the aforementioned paper base.

i) Samples were processed using PMTII activator in a suitable, diffusion transfer processor (e.g. Kodak Imagemate 43DT) with an unexposed projection negative donor, stripped apart immediately after the trailing edge had left the processor, and development was stopped instantly by immersing in a 5% acetic acid solution. The transmission density (DT) from different parts of the transferred silver halide was measured representing 6 and 12 second lamination times (Table 1).

TABLE 1

| Toner | | DT (6s) | DT (12s) |
|---|---|---|---|
| I, | 3-S-thiuronium propane sulfonate | 0.67 | 1.04 |
| II, | 3-S-thiuronium-2-methyl propane sulfonate | 0.63 | 0.95 |
| III, | 4-S-thiuronium butane sulfonate | 0.67 | 1.00 |
| IV, | 3-S-thiuronium 3-methyl-propane sulfonate | 0.61 | 0.93 |
| V, | 2-S-thiuronium ethane sulfonate | 0.63 | 0.93 |
| *5-methylbenzotriazole | | 0.41 | 0.65 |
| *2-phenyl-5-mercapto-oxadiazole | | 0.42 | 0.72 |

*Prior art toners

The results show that the toners of this invention accelerate the production of positive image, compared to the two cited toners of the prior art.

ii) Samples were processed with a step-wedge exposed continuous tone donor, stripped apart after 60 seconds lamination, the reflection density-log exposure curve measured and the 5-90 contrast measured (Table 2). (The 5-90 contrast being the gradient of a straight line drawn between 5% and 90% of the density range of the density-log exposure curve.)

TABLE 2

| Toner | | 5-90 Contrast |
|---|---|---|
| I, | 3-S-thiuronium propane sulfonate | 0.98 |
| II, | 3-S-thiuronium 2-methyl-propane sulfonate | 1.03 |
| III, | 4-S-thiuronium butane sulfonate | 1.20 |
| IV, | 3-S-thiuronium 3-methyl-propane sulfonate | 1.09 |
| V, | 2-S-thiuronium ethane sulfonate | 1.17 |

TABLE 2-continued

| Toner | 5-90 Contrast |
|---|---|
| 5-methylbenzotriazole | 1.53 |
| 2-phenyl-5-mercapto-oxadiazole | 2.60 |

The results show that the toners of this invention provide lower contrast when processed with a continuous tone donor, compared to the toners of the prior art.

The invention has been described in detail with particular reference to preferred embodiments thereof, but it will be understood that variations and modifications can be effected within the spirit and scope of the invention.

What is claimed is:

1. A silver complex diffusion transfer process, which process comprises the steps of exposing a photosensitive element containing a silver halide emulsion layer, developing the exposed photosensitive silver halide emulsion layer and forming a soluble silver complex of unexposed silver halide by treating the said photosensitive silver halide emulsion layer with an alkaline processing fluid in the presence of a developing agent and a silver halide complexing agent, transferring said soluble silver complex by diffusion to the silver receptive layer of an image-receiving element in superposed relationship with said silver halide emulsion, forming at said silver receptive layer an image incorporating silver from said silver complex under the action of development nuclei, and separating said image-receiving element from said photosensitive element, wherein said image-receiving element includes, in at least one layer thereof, an S-thiuronium alkyl sulfonate in an amount, within the range of 20 to 150 $mg/m^2$, effective to accelerate the physical development of silver, said S-thiuronium alkyl sulfonate having the general formula:

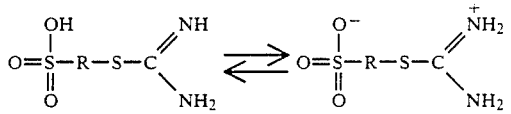

wherein R is a $C_1$-$C_6$ linear or branched, substituted or unsubstituted, alkylene group.

2. A silver complex diffusion transfer process as claimed in claim 1 wherein R is:

$$-CH_2CH_2CH_2- \quad (I)$$

$$-CH_2\overset{CH_3}{\overset{|}{C}}HCH_2- \quad (II)$$

$$-CH_2CH_2CH_2CH_2- \quad (III)$$

$$-CH_2CH_2\overset{CH_3}{\overset{|}{C}}H- \quad (IV)$$

or $$-CH_2CH_2- \quad (V)$$

* * * * *